United States Patent [19]

Six

[11] 4,097,276

[45] Jun. 27, 1978

[54] LOW COST, HIGH TEMPERATURE TURBINE WHEEL AND METHOD OF MAKING THE SAME

[75] Inventor: Lyle D. Six, Phoenix, Ariz.

[73] Assignee: The Garrett Corporation, Los Angeles, Calif.

[21] Appl. No.: 596,695

[22] Filed: Jul. 17, 1975

[51] Int. Cl.[2] ..... B22F 3/00; B22F 3/14

[52] U.S. Cl. ..... 75/208 R; 75/226; 29/156.8 R; 29/420; 416/241 B; 416/244 A

[58] Field of Search ..... 416/241 B, 244 A, 229 A, 416/244, 229, 241, 213, 219; 29/156.8 R, 156.8 B, 420.5, 420, DIG. 31; 75/208 R, 226, 214

[56] References Cited

U.S. PATENT DOCUMENTS

| | | | |
|---|---|---|---|
| 873,241 | 12/1907 | Imle | 416/213 |
| 876,123 | 1/1908 | Wilkinson | 416/213 |
| 2,769,611 | 11/1956 | Schwarzkopf | 75/208 R |
| 2,941,933 | 6/1960 | Roake et al. | 29/420 |
| 3,000,081 | 9/1961 | Webb | 29/156.8 R |
| 3,803,702 | 4/1974 | Bratt et al. | 29/420.5 |
| 3,844,778 | 10/1974 | Malone et al. | 75/208 R |
| 3,854,189 | 12/1974 | Ezis et al. | 29/420 |
| 3,873,234 | 3/1975 | Penny | 416/213 |
| 3,885,294 | 5/1975 | Chaundy et al. | 29/420 |
| 3,887,412 | 6/1975 | Styhr et al. | 156/89 |
| 3,905,723 | 9/1975 | Torti | 416/241 |
| 3,940,268 | 2/1976 | Catlin | 29/156.8 R |

FOREIGN PATENT DOCUMENTS

| | | | |
|---|---|---|---|
| 506,497 | 10/1954 | Canada | 29/156.8 R |
| 850,209 | 10/1960 | United Kingdom | 29/156.8 R |
| 811,922 | 4/1959 | United Kingdom | 416/219 |

*Primary Examiner*—C.W. Lanham
*Assistant Examiner*—Daniel C. Crane
*Attorney, Agent, or Firm*—Herschel C. Omohundro; James W. McFarland; Albert J. Miller

[57] ABSTRACT

This turbine wheel has a plurality of blades radiating from a central hub and is manufactured by a novel method including the steps of assembling a plurality of preformed ceramic or superalloy blades into a ring with foot portions on the blades projecting into the central region of the assembly, filling such central region with powdered ceramic material, such as silicon carbide, or a superalloy material, heating and isostatically pressing, at least the central region, to compact the powdered material around the foot portions into a unitary hub. The blade feet are suitably shaped to provide a precise interlocking engagement between the blades and the unitary hub.

4 Claims, 9 Drawing Figures

Figure 1:
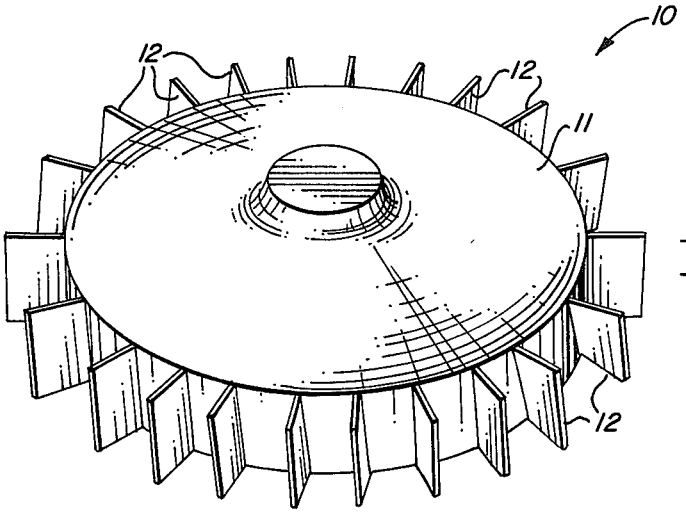

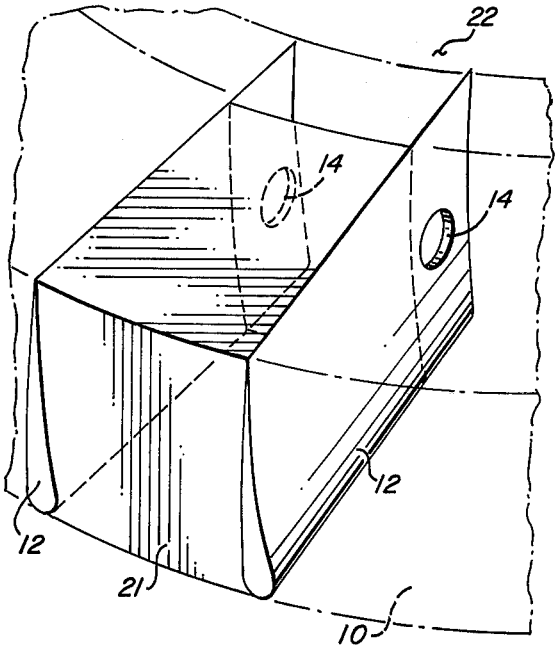
FIG. 6A
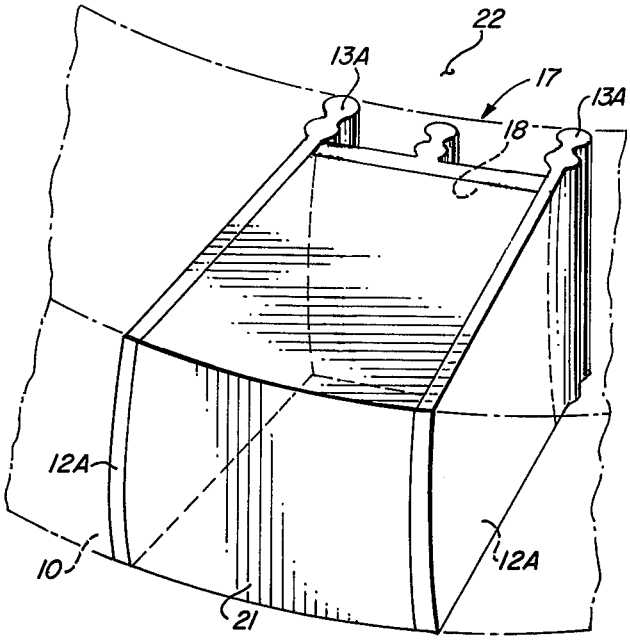
FIG. 6B
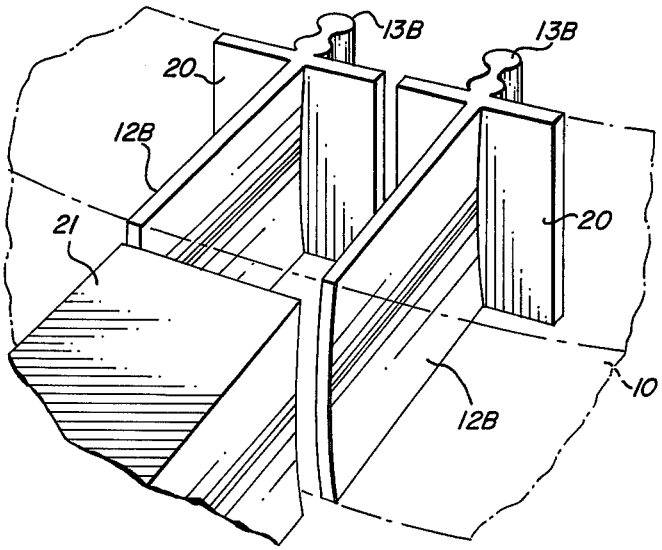
FIG. 6C
FIG. 7
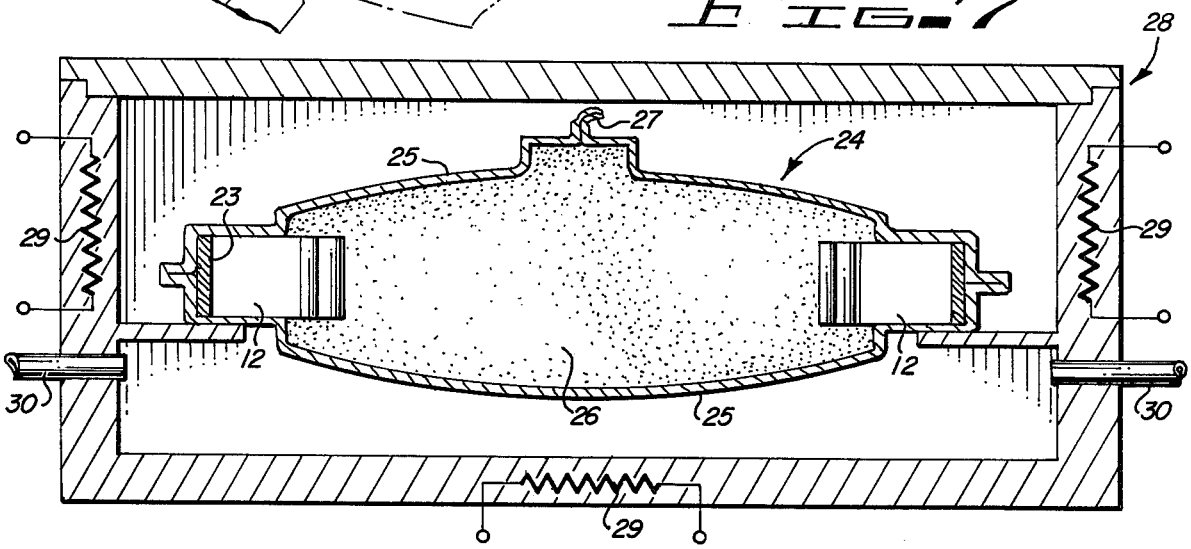

LOW COST, HIGH TEMPERATURE TURBINE WHEEL AND METHOD OF MAKING THE SAME

BACKGROUND OF THE INVENTION

The general field of this invention is the manufacture of rotors for high temperature gas turbine engines. More specifically, it relates to making gas turbine rotors or wheels of materials which will withstand the high temperature and corrosive action of hot gases while under the high stresses encountered during high speed operation. Some materials contemplated for such use are ceramics and superalloys. While ceramics resist high temperatures and corrosion better than most metals they are brittle and will break under stress or rough usage. It is contemplated, therefore, to construct hot wheels of a combination of materials each of which possesses desirable characteristics. For example, the blades and gas passage forming walls in the wheels under consideration may be made of ceramic material while the hub, shaft, and other parts may be made of superalloys which have high strength. Recently new materials have been developed which are suitable for use in high temperature operations and the method herein has been devised to produce wheels from such materials in a relatively economical and practical manner. The general field of this invention is exemplified by the United States patents listed as follows: U.S. Pat. Nos. 2,952,902 to Mora; 3,000,081 to Webb; 3,356,496 to Hailey; 3,622,313 to Havel; 3,698,962 to Kasak, et al; and 3,671,230 to Smythe, et al.

Kaysak et al and Smythe et al exemplify some powdered materials which may be used with the present method. Mora and Webb show methods of making turbine wheels of different materials and Hailey and Havel relate to methods of making articles of powdered materials. None of the listed patents shows the formation of a high temperature unitary wheel such as that produced by the method of this invention.

SUMMARY

This invention relates to the provision of a high temperature turbine wheel formed from a plurality of ceramic blades and a superalloy hub by a method which lends itself to relative low cost, mass production. It also relates to the production of turbine wheels from powdered materials which can be compacted at high temperature and pressure to a state resulting in a turbine wheel suitable for use at the stresses and temperatures experienced during turbine operations.

An object of this invention rests in the provision of a high temperature turbine wheel composed of ceramic and/or superalloy materials, the wheel being manufactured in such a way that the blade parts and hub will become a substantially integral unit.

Another object of the invention resides in the provision of a method of manufacturing gas turbine wheels in which preformed ceramic blades are arranged in ring-like order around a central region and such region is then filled with a suitable powdered material after which the assembled elements are heated to condition the powdered material which is then densified by compaction in the central region and around the inner portions of the blades to form a substantially one piece wheel having blades of high temperature resisting ceramic carried by a hub of high strength superalloy material.

A further object of the invention resides in providing a method of manufacturing gas turbine wheels which comprises providing a plurality of ceramic blades each having a foot portion, assembling the blades in the form of a ring with the foot portions projecting into the central region of the ring, providing spacers between the blades and closing the periphery of the central region, inserting a quantity of powdered ceramic, superalloy, or other suitable material into the central region and applying heat and pressing force to the central region to condition the powder and compact it around the blade feet to form a substantially solid hub with the blade feet embedded therein.

A still further object of the invention is to provide a method of making turbine wheels, such as that referred to in the preceding paragraph, in which the foot portion of each blade has a shape, such as a fir tree, perforations, or the like, which will form shoulder areas facing toward the outer side of the wheel and against which precisely complemental shoulder areas will be formed in the powder compacting operation to retain the blades in association with the hub during the operation of a turbine equipped with the wheel, the precise interface between the foot portions of the blades and hub providing for a uniform or favorable transfer of blade load to the hub.

Another object of the invention is to provide the methods mentioned in the preceding paragraphs with the step of placing preformed ceramic gas passage liner forming inserts between adjacent blades or providing projections directly on the ceramic blades to form gas passage liners; such inserts or projections limit the outward flow of the powdered material during the compacting step of the method and during the operation of a turbine equipped with the finished wheel, the liners protect the compacted superalloy hub material from the high velocity hot working fluid.

Other objects and advantages will become apparent, or be pointed out, as the description proceeds, steps of the method being illustrated in detail in the accompanying drawings.

IN THE DRAWINGS

FIG. 1 is a perspective view of a gas turbine wheel formed by the method of the present invention;

FIGS. 2, 3, 4, and 5 are perspective views of different designs of blades and gas passage liner forming elements which may be used with the method;

FIGS. 6A, 6B, and 6C are fragmentary perspective views illustrating somewhat schematically one of the steps employed in carrying out the method of the present invention; and FIG. 7 is a vertical sectional view illustrating still another step of the method and equipment employed in carrying out the invention.

DESCRIPTION OF THE DISCLOSURE

Particular reference to FIG. 1 of the drawings discloses that a gas turbine wheel 10 formed by the method of this invention includes a generally circular hub 11 and a plurality of blades 12 radiating therefrom. The blades 12 are of the usual airfoil design and are twisted in a conventional manner consistent with the use of the wheel. The blades are spaced around the hub to provide gas passages through which the hot gases flow during the operation of the gas turbine engine equipped with the wheel.

Figure 2:
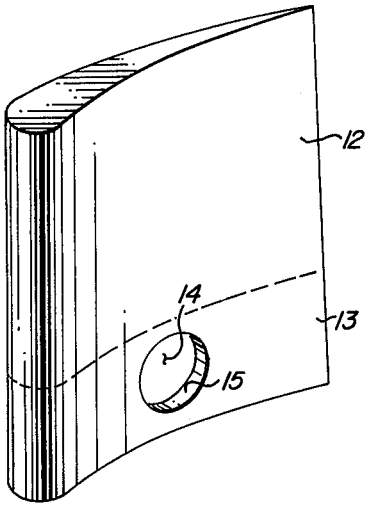
Figure 3:
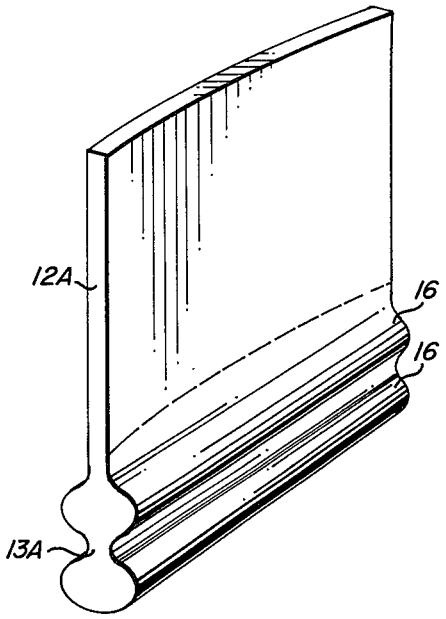
Figure 4:
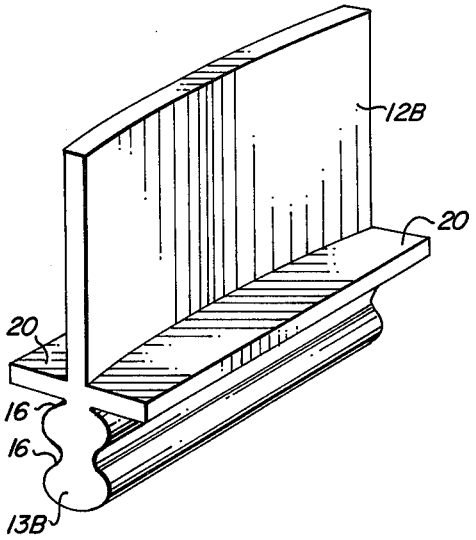

As shown in FIGS. 2, 3, and 4, each of the blades 12, 12A, or 12B has a foot portion 13, 13A, or 13B for purposes which will be set forth as the description proceeds. The foot portion 13 of blade 12 is of a relatively simple design being substantially plate-like and having at least one hole 14, or perforation, extending therethrough. It will be obvious that the hole 14 provides a surface area 15 (one half of the bore surface) facing toward the outer or wheel peripheral end of the blade. The foot portions 13A and 13B of blades 12A and 12B are provided with the commonly known fir tree shape which has a plurality of ridges and grooves. These shapes also form surface areas 16 facing toward the outer or wheel peripheral ends of the blades.

Figure 5:
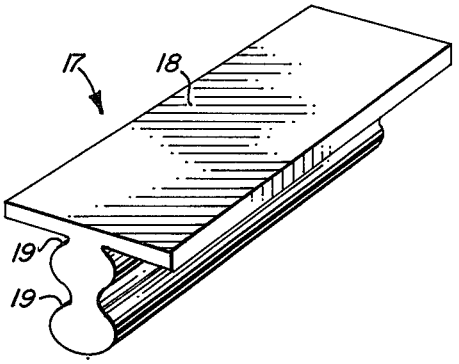

FIG. 5 shows a gas passage liner forming element 17 having a strip-like body 18 with a fir tree shaped foot projecting therefrom. This foot, like those on blades 12A and 12B, has surface areas 19 facing toward the wheel periphery. Element 17 is used in combination with blades 12 or 12A. It will be noted that the blade 12B has projections 20 at each side adjacent the foot portion which serve as gas passage liner forming means in the completed wheel instead of using elements 17.

As shown in FIGS. 6A, 6B, and 6C, one step in the method of the invention is carried out by assembling a suitable number of blades 12, 12A, or 12B and spacer members 21 to form a ring surrounding a central region 22. The spacer members 21 must be formed of suitable material which will separate or may be easily separated from the blades following completion of the wheel. If blades 12 or 12A are used a gas passage liner forming element 17 is employed between adjacent blades. In addition to forming a ceramic liner for the passage between the blades to protect the superalloy hub from the high velocity hot gases in the operation of the wheel it also closes the periphery of the central region to confine the powdered material during the pressing step. It should be clear that the spacers 21 are employed to precisely position the blades in the step of assembling them in ring form. They also hold the elements 18 against displacement in a subsequent step of the method. When blades 12B are employed the projections 20 take the place of the elements 17 with the body 18. After the blades, spacers, and gas passage liners 17 (if required) are assembled in ring form, a band of steel 23, or other suitable material, is applied to the periphery of the assembly to hold the parts in assembled relationship. If found necessary provisions could be made to contract the band into the parts retaining position.

The clamped assembly or ring with the foot portions of the blades and liner forming elements projecting into the central region 22 is now inserted into a container 24. This member is of a vitrious material and shaped to generally fit around the ring formed by the blades and spacers; it is enlarged, as at 25, in the vicinity of the central region 22 at the top and bottom, when the assembly is viewed as in FIG. 7, to receive sufficient powder to compensate for compacting in a subsequent step of the method. A portion of the top, or the top itself, of the container 24 is left open to permit a suitable quantity of powdered material 26 to be placed in the central region 22. Material 26 may be either a ceramic or a metallic or a combination depending upon the desires of the manufacturer and availability of suitable material. A quantity of the material suitable to fill the enlarged central region of the container is provided. Following the placing of the powder in the central region of the ring assembly and container, the latter is evacuated and sealed as at 27. If found necessary or desirable the container could be charged with an inert gas prior to sealing.

After the container is sealed, it and its contents are heated to the extent necessary to soften or otherwise condition the container and the powdered material inserted therein. Suitable compressive force is then applied to the exterior of the container to compact the conditioned powder and cause it to flow around the foot portions of the blades and gas passage liner forming elements (if used). One form of apparatus for carrying out the heating and compacting steps of the method has been illustrated schematically in FIG. 7. Such apparatus includes an enclosure, oven or kiln 28 in which the loaded container 24 is suitably supported. Appropriate heating elements 29, or other means, are provided to raise the temperature of the container and its contents to the predetermined degree and air, gas or other fluid pressure is supplied through one or more inlets 30 to apply isostatic pressure to the exterior of the container. As the latter softens, the contents will be under equal pressures from all sides and the powder in the central region will be compacted and densified. After suitable compaction has taken place (approximately 30% of the powder volume) the container and contents are cooled to permit the setting of the hub into a unitary mass. Since the hub material flowed and was compacted around the foot portions of the blades a precisely intimate interlocking relationship will result. In certain instances, depending upon the material, the temperatures, and the compressive forces used, the hub and blade parts may fuse into one piece.

It is within the concept of this invention to employ enough powdered material in the hub area to provide an integral stub shaft or if desired a shaft may be welded to the wheel following removal thereof from the container 24.

After a wheel is formed according to the method of the invention additional finishing operations, such as grinding, machining, polishing etc., may be performed, if necessary.

I claim:

1. A method of manufacturing turbine wheels of the type having a plurality of blades radiating from a central hub comprising the steps of:

a. providing a ring of alternately arranged blades and spacers, said blades being preformed with each having a foot portion projecting into the central region of the ring and with shoulder surface areas on said foot portions facing outwardly from the central region;

b. securing the blades and spacers together to retain them in ring forming order;

c. substantially completely enclosing the assembly of blades, spacers, and securing means in a heat softenable container;

c. filling the central region around the foot portions of the blades with a powdered heat softenable material;

e. evacuating and sealing the container;

f. heating the container and contents to soften the container and the powdered material; and g. applying isostatic pressure to the exterior of the container inwardly to collapse the container from substantially all sides and to compact the heated powdered material therein into a unitary mass around and completely enveloping the foot portions of the blades to form inwardly facing shoulders of the compacted heated powdered material opposite to and interlocking with the shoulder surface areas of said foot portions to intersecure the blades and the compacted heated powdered material.

2. The method of manufacturing turbine wheels set forth in claim 1 in which the blades are composed of ceramic material.

3. The method of manufacturing turbine wheels set forth in claim 1 in which the foot portions of the preformed blades have fir tree shapes defining said shoulder surface areas.

4. The method of manufacturing turbine wheels set forth in claim 1 in which the preformed blades are provided with laterally directed projections adjacent the foot portions to form gas passage liners on the hub between adjacent blades, said liners preventing contact between said spacers and said powdered material.

* * * * *